United States Patent [19]

Buzzi

[11] 4,226,107

[45] Oct. 7, 1980

[54] DEVICE FOR EDGING THE POINTS OF BALL PENS IN PARTICULAR THOSE MADE OF HARD MATERIAL

[75] Inventor: Ugo Buzzi, Arzo, Switzerland

[73] Assignee: Albe SA, Agno, Switzerland

[21] Appl. No.: 963,920

[22] Filed: Nov. 21, 1978

[30] Foreign Application Priority Data

Nov. 29, 1977 [CH] Switzerland ..... 14634/77
Oct. 13, 1978 [CH] Switzerland ..... 10614/78

[51] Int. Cl.[3] ..... B21D 19/06
[52] U.S. Cl. ..... 72/121; 72/123; 113/32 BP
[58] Field of Search ..... 113/32 BP; 72/121, 123, 72/241

[56] References Cited

U.S. PATENT DOCUMENTS

| | | | |
|---|---|---|---|
| 3,135,231 | 6/1964 | Schachter | 113/32 PB |
| 3,473,358 | 10/1969 | Marcovitch | 72/121 |
| 3,815,397 | 6/1974 | Hollencamp | 72/121 |
| 4,143,535 | 3/1979 | Bouman | 72/121 |
| 4,163,379 | 8/1979 | Buzzi | 113/32 BP |

*Primary Examiner*—Lowell A. Larson
*Attorney, Agent, or Firm*—Young & Thompson

[57] ABSTRACT

A device for edging points of ball point pens wherein three equiangularly spaced rollers run on a conical surface. The point to be worked is moved into a working zone defined by regions of the three rollers in a direction along the axis of the conical surface in a direction from the apex of the conical surface towards the wider end of the conical surface. The rollers either react against a rotatable disc or a fixed shaft, in which latter case the conical surface is rotatable.

7 Claims, 7 Drawing Figures

DEVICE FOR EDGING THE POINTS OF BALL PENS IN PARTICULAR THOSE MADE OF HARD MATERIAL

This invention relates to the edging of the point of a ball point pen.

The edging of the point of a ball point pen involves the working of the edge region of the socket of the tip of a ball point pen which holds the ball, the working of the said edge region having the effect of retaining the ball in the socket.

According to the invention there is provided along the axis of the conical surface a device for edging the point of a ball point pen comprising three working rollers arranged to run without slip on a conical running surface and arranged at 120° angular spacing so that regions of the rollers co-operate to define a working zone into which the point is moved to be engaged by said regions. The arrangement is such that the point has to be moved into said working zone along the axis of the conical surface in a direction from the apex to the wider end of the conical surface.

In one arrangement, there is a rotatable disc on which the said rollers react when the rollers are working on a point of a ball point pen, said disc being supported relative to the conical surface by ball or roller bearing means.

In another arrangement, the rollers react on the tapered end of a stationary shaft which is urged towards the rollers by resiliently yieldable means, the conical surface being rotatable by being supported by a ball or roller bearing means.

Embodiments of the invention will now be described, by way of example, with reference to the accompanying drawings, wherein.

Figure 1:
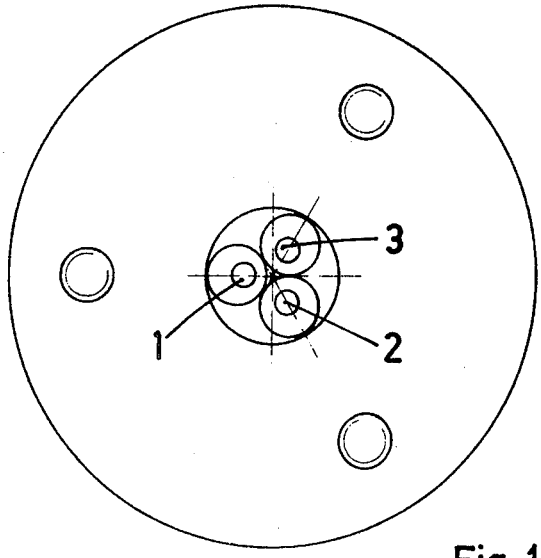
FIG. 1 is an underneath plan view of a device according to the present invention.
Figure 2:
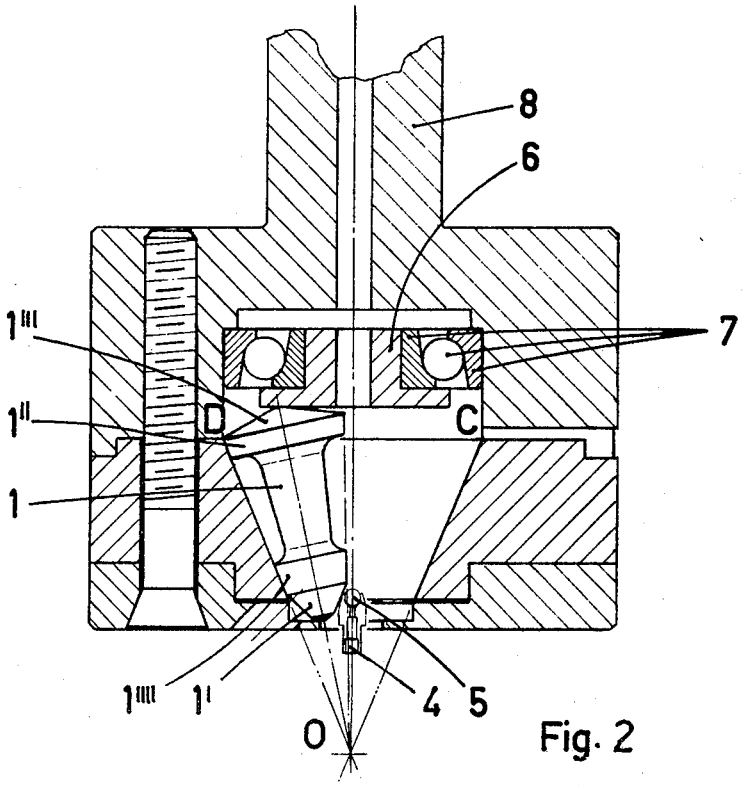
FIG. 2 is an axial section of the device of FIG. 1, and illustrates a first embodiment of the invention, only one of the working rollers being shown in this figure.

Referring to FIGS. 1 and 2, three rollers 1, 2 and 3, which although not of exact geometric form, nevertheless are essentially conical rollers as will be understood, are arranged so that their axes meet at apex point O defined by the roller running surface cone COD. The ball point pen to be edged is illustrated by the reference numerals 4 and 5. The rollers 1, 2 and 3 are arranged to rotate without slip on the conical seating COD and they also engage the edge of the point to be worked in a working zone at such location that there is no relative slip between the rollers and the edge being worked. On the wider end of the conical surface COD there is provided a tail 8 which is drivingly connected to a mandrel (not shown) of the machine on which the device is mounted.

The three conical rollers 1, 2 and 3, of which only roller 1 is shown in FIG. 2 have a conical working region 1'—which engages the edge of the point to be worked, whilst the raised surfaces 1'',1''' run on the conical seating COD. There is an end conical surface 1'''' which presses on the disc 6, the disc in turn being supported by ball or roller bearing means 7 on the tail 8 so as to rotate freely thereon.

As follows clearly from FIG. 2, the conical seating COD on which the rollers 1, 2 and 3 run is large and therefore the running is much smoother and easier as compared with the arrangement as illustrated in Swiss Pat. No. 506,167 filed on Feb. 2, 1977 by the same applicant. In that Swiss patent the conical rollers and converging axis thereof are arranged in the opposite direction.

Figure 3:
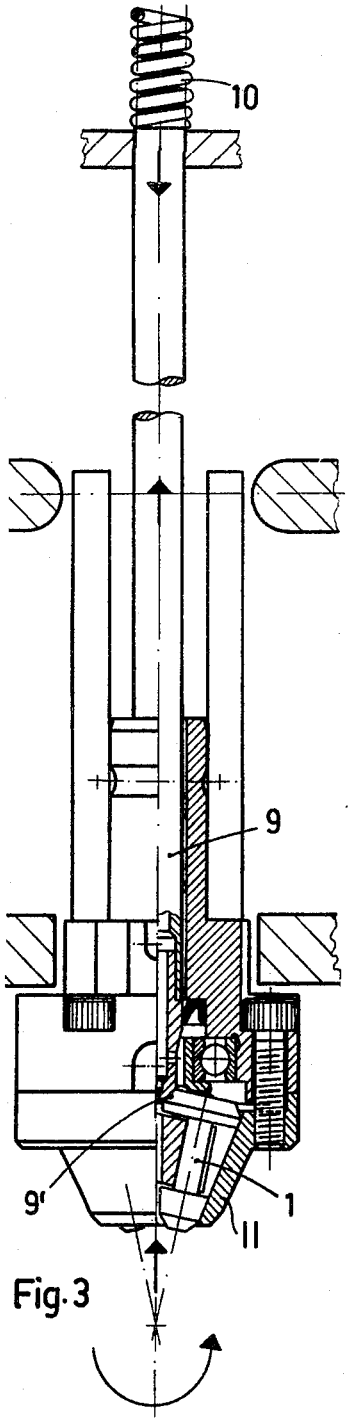
FIG. 3 shows, half in axial section, a second embodiment of the invention.

In the arrangement shown in FIG. 3, the three conical rollers (only one is shown), react on the tapered end 9' of a nonrotatable shaft 9. The shaft is urged axially by yieldable resilient means in the form of spring 10 towards the rollers. In this arrangement, the means defining the conical surface COD, namely the housing 11 is rotatable, the rotation of which causes rotation of the three working rollers, the drive being achieved by friction. The rollers frictionally engage the said tapered end 9' in use when they come into contact with the edge of the point of the ball point pen to be worked. During such working operation when the rollers 1, 2 and 3 engage at the point to be worked there is only turning friction between the point and the rollers and therefore there is no relative slip between the engaging surfaces. In particular, the working line B on working region 1' is in alignment with a point A at which there is no slip between the conical surface 1'' and the said apex 0.

Figure 4:
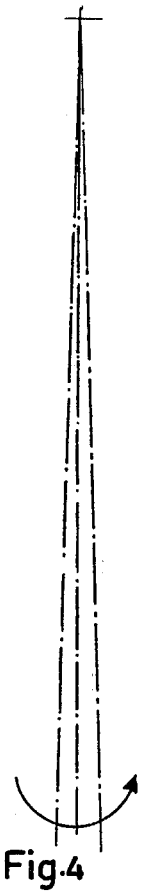
FIG. 4 is a diagram illustrating how the rollers of the device can be oscillated for the perfect adaptation of the rollers to the point to be edged.

For the purpose of better adapting the three rollers 1, 2 and 3 in position with respect to the point 4, 5 to be worked, it is arranged that the seating 11 which carries the rollers can oscillate angularly to a limited extent, for example the extent as shown in FIG. 4.

Figure 5:
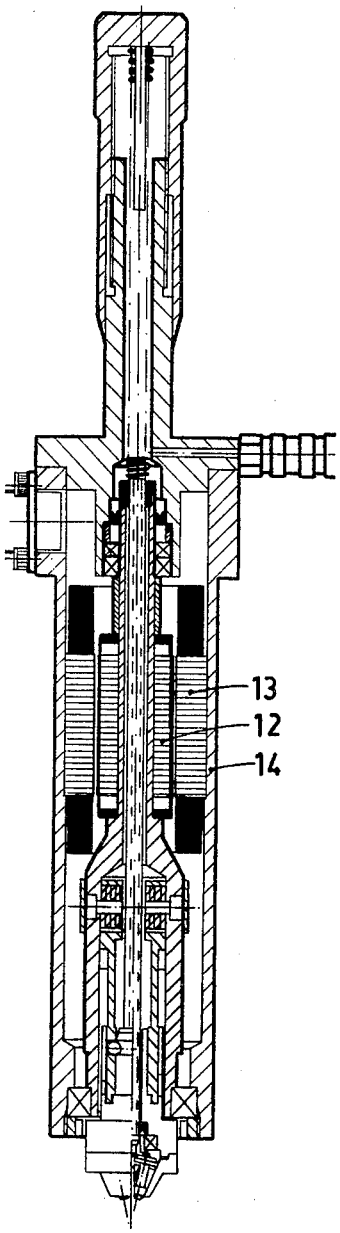
FIG. 5 shows an axial section a specific arrangement in accordance with the embodiment of the invention illustrated in FIG. 3.

In the arrangement shown in FIG. 5 in which the conical seating 11 carries the rollers, the said seating is drivable by means of the rotor 12 of an electric motor, the stator 13 of which is contained in an outer cover which envelopes the whole motor assembly, which provides for maximum compactness and permits the edging to be carried out at very high speed and with a high degree of accuracy.

Figure 7:
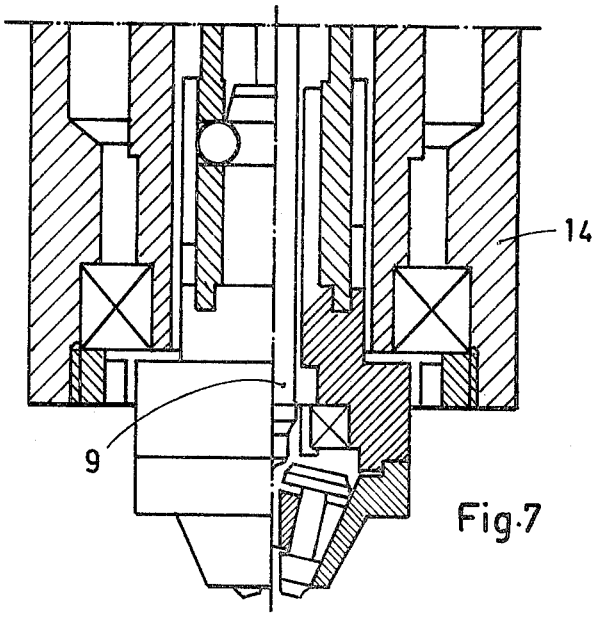
FIG. 7 illustrates also to a larger scale the end of the device shown in FIG. 5.
Figure 6:
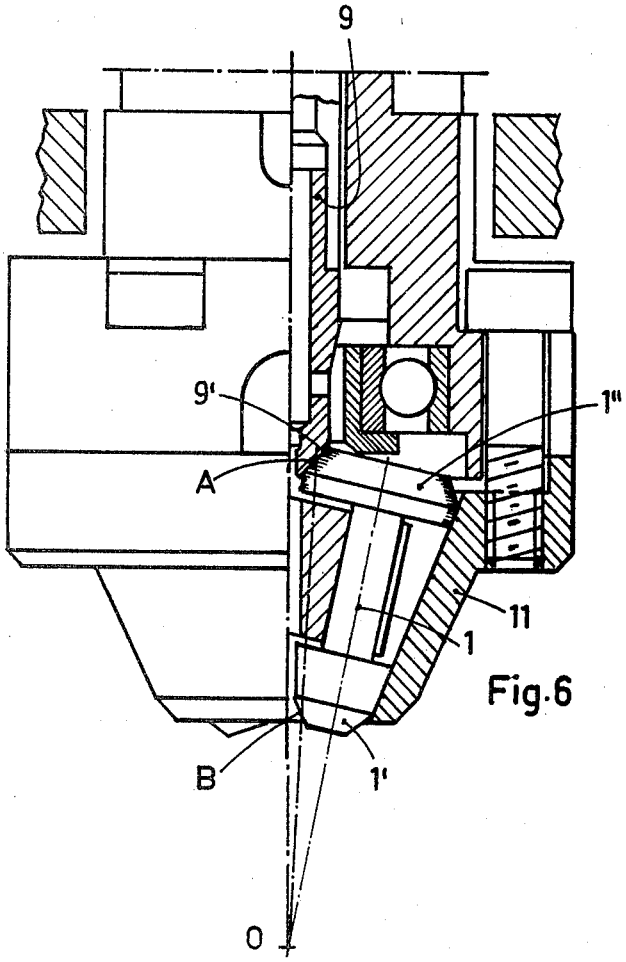
FIG. 6 shows partly in axial section and to a larger scale the working end of the device shown in FIG. 3.

As regards the arrangement shown in FIG. 7, this is an enlarged view given for the purpose of clarity.

The said rollers 1, 2 and 3 and the conical seating on which they roll without slip are preferably made of very hard steel, or alloys or other hard metal, so as to permit the working of the points for ball point pens, which also are of very hard metal, such as for example, stainless steel.

I claim:

1. A device for edging the point of a ball point pen comprising three working rollers arranged to run without slip on a conical running surface and arranged at 120° angular spacing so that regions of the rollers cooperate to define a working zone into which the point is moved to be engaged by said regions, the axes of the three rollers converging at the apex of said conical surface, a stationary shaft having a tapered end, resiliently yieldable means urging said tapered end towards the rollers, and ball or roller bearing means rotatably supporting said conical surface.

2. A device according to claim 1, wherein there is a rotatable disc on which the said rollers react when the rollers are working on a point of a ball point pen, said disc being supported relative to the conical surface by ball or roller bearing means.

3. A device according to claim 2, wherein each roller has a conical reaction surface which bears upon said disc.

4. A device according to claim 1, wherein the conical surface is rotatable and can osciallate so that its axis can oscillate within a limited angle to allow for the perfect adaptation of said rollers to the point to be worked.

5. A device according to claim 1, including an electric motor adapted to drive a mandrel to which said conical surface is connected.

6. A device according to claim 1, wherein said each roller has spaced conical surfaces which run on the said conical surface.

7. A device according to claim 1, wherein said rollers and the conical surface are of very hard steel, alloy or other hard metal.

* * * * *